US006817592B2

(12) United States Patent
Mianzo et al.

(10) Patent No.: US 6,817,592 B2
(45) Date of Patent: Nov. 16, 2004

(54) ELECTROMAGNETIC VALVE ACTUATOR WITH SOFT-SEATING

(75) Inventors: Lawrence Andrew Mianzo, Plymouth, MI (US); Brett Collins, Ypsilanti, MI (US); Ibrahim Haskara, Brownstown, MI (US); Vladimir V. Kokotovic, Bloomfield Hills, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 101 days.

(21) Appl. No.: 10/105,780

(22) Filed: Mar. 25, 2002

(65) Prior Publication Data

US 2003/0107017 A1 Jun. 12, 2003

Related U.S. Application Data

(60) Provisional application No. 60/339,573, filed on Dec. 11, 2001.

(51) Int. Cl.[7] ..... F16K 31/02

(52) U.S. Cl. ..... 251/54; 251/129.16; 251/48; 92/85 B

(58) Field of Search ..... 251/129.16, 129.19, 251/48, 54; 92/85 B, 143, 129.1

(56) References Cited

U.S. PATENT DOCUMENTS

| | | | | |
|---|---|---|---|---|
| 4,515,343 A | | 5/1985 | Pischinger et al. | |
| 4,777,915 A | | 10/1988 | Bonvalletg | |
| 4,883,025 A | * | 11/1989 | Richeson, Jr. | 251/48 |
| 5,016,790 A | * | 5/1991 | Thomas et al. | 251/54 |
| 5,592,905 A | | 1/1997 | Born | |
| 5,791,305 A | | 8/1998 | Kather et al. | |
| 5,832,883 A | | 11/1998 | Bae | |
| 5,917,692 A | | 6/1999 | Schmitz et al. | |
| 6,003,481 A | | 12/1999 | Pischinger et al. | |
| 6,047,673 A | | 4/2000 | Lohse et al. | |
| 6,066,999 A | | 5/2000 | Pischinger | |
| 6,073,651 A | | 6/2000 | Conrads et al. | |
| 6,076,490 A | * | 6/2000 | Esch et al. | 251/129.1 |
| 6,101,992 A | | 8/2000 | Pischinger et al. | |
| 6,176,208 B1 | | 1/2001 | Tsuzuki et al. | |
| 6,293,514 B1 | * | 9/2001 | Pechoux et al. | 251/129.19 |
| 6,427,971 B1 | | 8/2002 | Kawabe et al. | |
| 6,592,095 B2 | * | 7/2003 | Kabasin et al. | 251/54 |

FOREIGN PATENT DOCUMENTS

| | | |
|---|---|---|
| DE | 19960796 | 9/2000 |
| EP | 0870906 | 3/1998 |
| EP | 0281192 | 9/1998 |
| EP | 1255026 | 3/2002 |
| JP | 7305612 | 11/1995 |
| JP | 11229833 | 8/1999 |
| JP | 19836562 | 3/2000 |

OTHER PUBLICATIONS

WO 00/71861 A1, PCT/EP00/04463, Schmitz et al., Method For Controlling An Elecromagnetic Valve Drive Mechanism For A Gas Exchange Valve In An Internal Combustion Piston Engine, Nov. 30, 2000.

* cited by examiner

*Primary Examiner*—John Bastianelli
(74) *Attorney, Agent, or Firm*—Brinks Hofer Gilson & Lione

(57) ABSTRACT

The electromagnetic valve actuator of the preferred embodiments include a valve head that moves between an open position, a middle position, and a closed position; a plunger coupled to the valve head; and a housing defining a cavity that surrounds the plunger and contains a fluid. The cavity cooperates with the plunger and the fluid to provide increasing resistance as the valve head moves from the middle position to the closed position. Because of the increased resistance, the valve head softly seats against a valve seat, which minimizes noise, vibration, and harshness within the vehicle.

11 Claims, 3 Drawing Sheets

ELECTROMAGNETIC VALVE ACTUATOR WITH SOFT-SEATING

CROSS-REFERENCE TO RELATED APPLICATIONS

The present invention claims priority to U.S. Provisional Application Ser. No. 60/339,573 entitled "Method for passive or semi-active soft-landing for an electromagnetic actuator", filed 11 Dec. 2001, and incorporated in its entirety by this reference.

TECHNICAL FIELD

This invention relates generally to the valve actuation field and, more specifically, to an improved electromagnetic valve actuator for an engine of a vehicle.

BACKGROUND

In a conventional engine of a typical vehicle, a valve is actuated from a closed position against a valve seat to an open position at a distance from the valve seat to selectively pass a fluid, such as a fuel and air mixture, into or out of a combustion chamber. Over the years, several advancements in valve actuations, such as variable valve timing, have improved power output, fuel efficiency, and exhaust emissions. Variable valve timing is the method of actively adjusting either the duration of the close or open cycle, or the timing of the close or open cycle of the valve. Several automotive manufacturers, including Honda and Ferrari, currently use mechanical devices to provide variable valve timing in their engines.

A more recent development in the field of variable valve timing is the use of two solenoid coils located on either side of an armature to open and close the valve heads. Activation of one of the solenoid coils creates an electromagnetic pull on the armature, which moves the valve in one direction. Activation of the other solenoid coil creates an electromagnetic pull on the armature, which moves the valve in the other direction. This system, also known as electromagnetic valve actuator (or "EMVA"), allows for an infinite variability for the duration and timing of the open and close cycles, which promises even further improvements in power output, fuel efficiency, and exhaust emissions.

In an engine, it is desirable to swiftly move the valve between the open position and the closed position and to "softly seat" the valve against the valve seat. The force created by the EMVA, which is related to the distance between the solenoid coil and the armature, increases nonlinearly as the armature approaches the solenoid coil. In fact, the solenoid coil can forcefully slam the armature against the solenoid coil, which may also forcefully slam the valve head into the valve seat. The slamming of the valve against the valve seat, or the slamming of the armature against the solenoid coils, causes undesirable noise, vibration, and harshness ("NVH") within the vehicle. Thus, there is a need in the automotive industry to create an EMVA with soft seating capabilities.

DESCRIPTION OF THE PREFERRED EMBODIMENTS

The following description of the two preferred embodiments of the invention is not intended to limit the invention to these preferred embodiments, but rather to enable a person skilled in the art to make and use this invention.

The electromagnetic valve actuator ("EMVA") of the preferred embodiments of the invention is specifically designed for an engine of a vehicle. The EMVA, however, may alternatively be used in other suitable devices, such as in an engine of a watercraft or aircraft or in other fluid actuating systems.

Figure 1A:
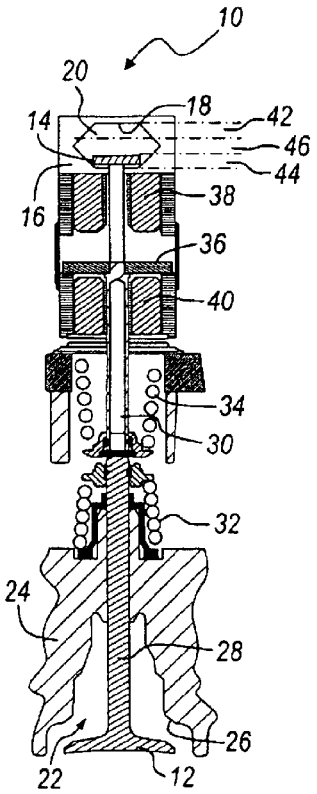
FIGS. 1A, 1B, and 1C are cross-sectional views of an electromagnetic valve actuator of the first variation of the first preferred embodiment.
Figure 1B:
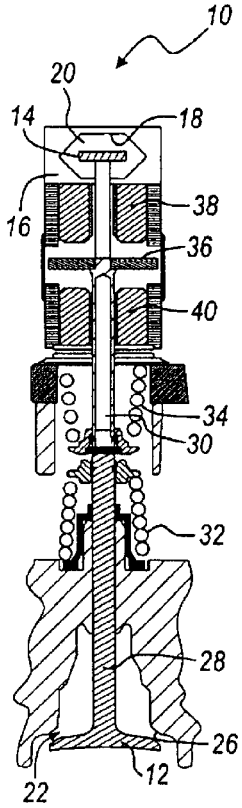
Figure 1C:
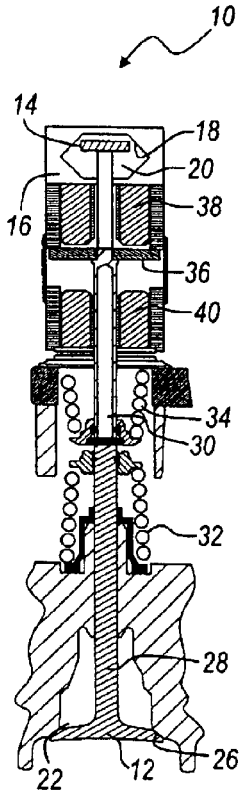

As shown in FIGS. 1A, 1B, and 1C, the EMVA 10 of the first preferred embodiment includes a valve head 12 that moves between an open position (shown in FIG. 1A), a middle position (shown in FIG. 1B), and a closed position (shown in FIG. 1C); a plunger 14 coupled to the valve head 12; and a housing 16 defining a cavity 18 that surrounds the plunger 14 and contains a fluid 20. The cavity 18 cooperates with the plunger 14 and the fluid 20 to provide increasing resistance as the valve head 12 moves from the middle position to the closed position. The EMVA 10 may, of course, include other suitable elements, such as the elements described below and other elements, such as seals and heat transfer devices, envisioned by a skilled person in the art.

The valve head 12 of the first preferred embodiment functions to selectively pass fluid through an orifice 22 by moving from a closed position to an open position. Preferably, the valve head 12 selectively moves a distance from the orifice 22, which allows the passage of a fuel and air mixture into a combustion chamber 24 of an engine (only partially shown), and then moves against a valve seat 26 around the orifice 22 to block the passage of the fuel and air mixture. Alternatively, the valve head 12 may selectively pass any suitable fluid from any suitable conduit to any other suitable conduit. The valve head 12 is preferably a conventional device typically found on a conventional internal combustion engine, but may alternatively be any suitable device to selectively pass a fluid in a liquescent, gaseous, or combination state.

The first preferred embodiment also includes a primary valve stem 28, which functions to actuate the valve head 12 from a location remote from the orifice 22. The primary valve stem 28 is preferably formed with the valve head 12, but may alternatively be fastened to the valve head 12. The primary valve stem 28 is preferably a conventional device typically found on a conventional internal combustion engine, but may alternatively be any suitable device to allow remote actuation of the valve head 12.

The first preferred embodiment also includes a secondary valve stem 30, a first spring 32, and a second spring 34, which collectively cooperate with the primary valve stem 28 to substantially negate the effects of temperature changes on the EMVA 10. The first spring 32 biases the primary valve stem 28 toward the secondary valve stem 30, while the second spring 34 biases the second valve stem toward the primary valve stem 28. In this manner, the primary valve stem 28 and the secondary valve stem 30 substantially act as one unit during the movement of the valve head 12, but allow for the elongation of the primary valve stem 28 caused by temperature fluctuations within the engine. In addition to providing forces to bias the primary valve stem 28 and the secondary valve stem 30 together, the first spring 32 and the second spring 34 are preferably designed to bias the valve head 12 into an equilibrium position or "middle position" (shown in FIG. 1B) between the open position and the closed position. The secondary valve stem 30, the first spring 32, and the second spring 34 are preferably conventional devices, but may alternatively be any suitable device to negate the temperature effects.

The first preferred embodiment also includes an armature 36 coupled to the valve head 12 through the secondary valve stem 30 and the primary valve stem 28, a first solenoid coil 38 located on one side of the armature 36, a second solenoid coil 40 located on the other side of the armature 36, and a control unit (not shown). Preferably, the armature 36 extends from the secondary valve stem 30 with a rectangular, cylindrical, or other appropriate shape and includes a magnetizable and relatively strong material, such as steel. The first solenoid coil 38 functions to create an electromagnetic force on the armature 36 to move the valve head 12 into the closed position, while the second solenoid coil 40 functions to create an electromagnetic force on the armature 36 to move the valve head 12 into the open position. The control unit functions to alternatively activate the first solenoid coil 38 and the second solenoid coil 40 to move the valve head 12 from open position, through the middle position, and into the closed position and to move the valve head 12 from the closed position, through the middle position, and into the open position. The control unit preferably allows for the continuous operation of the valve head 12 with a cycle time of about 3 milliseconds, depending on the spring constants, the distance of armature travel, and the mass of the elements, amongst other factors. The first solenoid coil 38, the second solenoid coil 40, and the control unit are preferably conventional devices, but may alternatively be any suitable device to selectively move the valve head 12 between the open position and the closed position through the use of an electromagnetic force.

The plunger 14 of the first preferred embodiment functions to cooperate with specific regions of the cavity 18 (as discussed below) and the fluid 20 to provide a resistance to the electromagnetic force of the first solenoid coil 38 and the second solenoid coil 40 on the armature 36. The plunger 14 is preferably fastened to the secondary valve stem 30, but may alternatively be coupled to the valve head 12 through any suitable device or arrangement. The plunger 14 preferably has a cylindrical shape, but may alternatively have another suitable shape. The plunger 14 is preferably made from a relatively strong material, such as steel or magnesium, but may be made from any suitable material that adequately resists significant deflection and deformation.

The housing 16 of the first preferred embodiment functions to define the cavity 18 surrounding the plunger 14 and to contain the fluid 20. The cavity 18 preferably includes a first region 42 that cooperates with the plunger 14 and the fluid 20 to provide increasing resistance as the valve head 12 moves from the middle position to the closed position, and a second region 44 that cooperates with the plunger 14 and the fluid 20 to provide increasing resistance as the valve head 12 moves from the middle position to the open position, and a third region 46 between the first region 42 and the second region 44. Preferably, the increasing resistance provided by the first region 42 and the second region 44 substantially reduces or negates the increasing pull of the armature 36 by the respective solenoid coil. Because of the increased resistance, the armature 36 softly lands against the respective solenoid coil and, more importantly, the valve head 12 softly lands against the valve seat 26, which minimizes noise, vibration, and harshness (NVH). "Soft seating" is defined as a speed for the armature and the valve head 12 to seat against the respective solenoid coil and the valve seat 26 with acceptable NVH and durability. In some circumstances, the "soft seating" will be a speed equal to or less than about 0.1 meters per second.

Figure 2A:
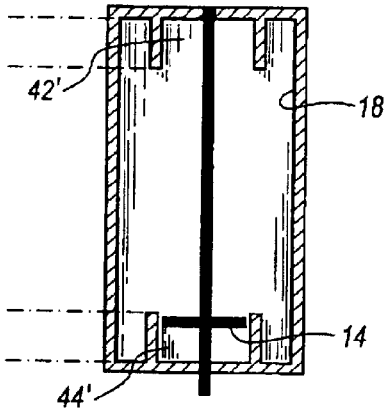
FIGS. 2A and 2B are schematic views of a housing, plunger, and fluid arrangement of the second variation of the first preferred embodiment.
Figure 2B:
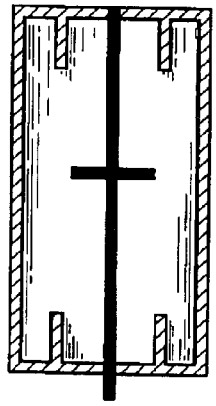
Figure 3A:
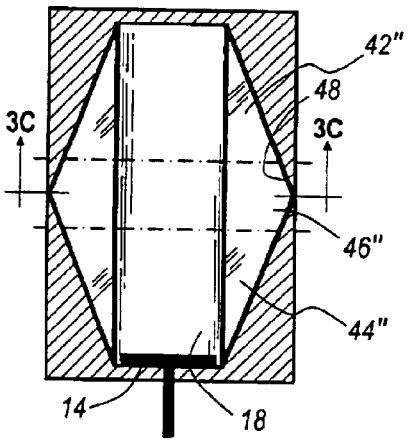
FIGS. 3A, 3B, and 3C are schematic views of a housing, plunger, and fluid arrangement of the third variation of the first preferred embodiment.
Figure 3B:
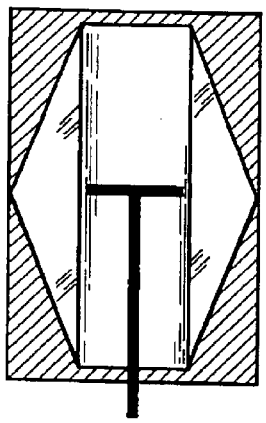
Figure 3C:
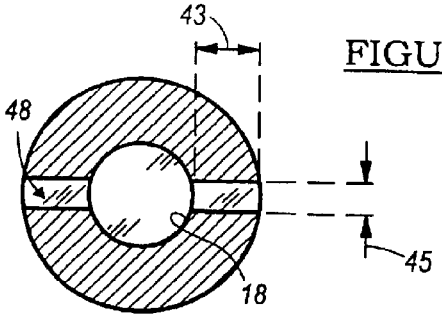

The third region 46 of the cavity 18 of the first preferred embodiment has a greater cross-sectional area than the first region 42 and a greater cross-sectional area than the second region 44. The exact shape of the cavity 18, however, may vary. In the first variation, the first region 42 and the second region 44 define substantially conical shapes, which taper to a diameter just larger than the diameter of the plunger 14. In a second variation, as shown in FIGS. 2A and 2B, the first region 42' and the second region 44' define substantially cylindrical shapes, which receive the plunger 14. In a third variation, as shown in FIGS. 3A, 3B, and 3C, the first region 42" and the second region 44" define substantially cylindrical shapes with an axial channel 48 having a varying radial depth 43 and a substantially constant width 45. More specifically, the axial channel 48 radially extends in the third region 46" more than in the first region 42" and the second region 44" such that the radial depth 43 is greater in the third region 46" than in the first region 42" and the second region 44". These three variations are not, of course, intended to limit the design of the cavity 18, but rather to enable a person skilled in the art to make and use this invention.

As shown in FIG. 1A, the fluid 20 of the first preferred embodiment functions to cooperate with the plunger 14 and specific regions of the cavity 18 to provide resistance. The fluid 20 is preferably any acceptable fluid, including air.

Figure 4:
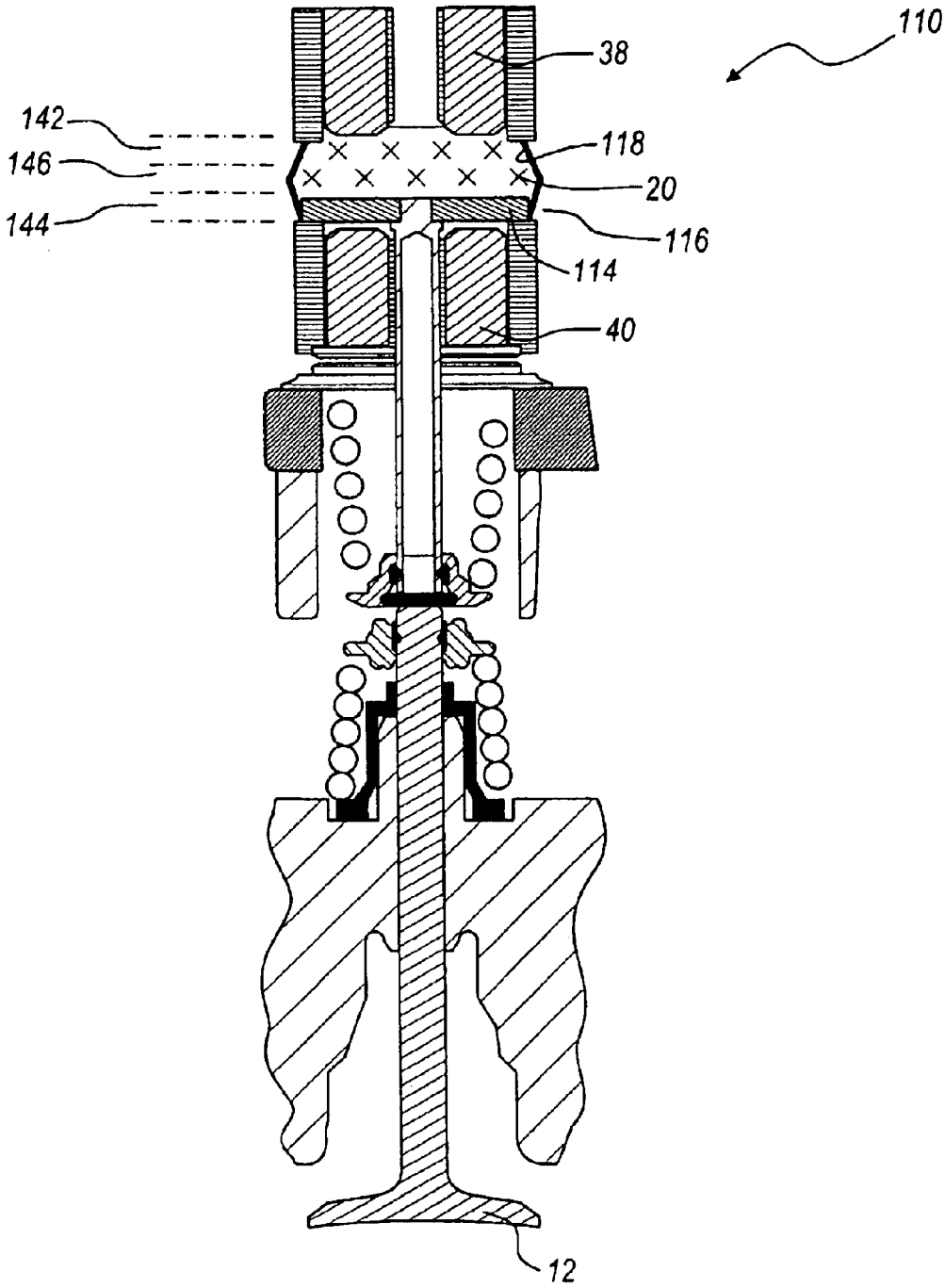
FIG. 4 is a cross-sectional view of an electromagnetic valve actuator of the second preferred embodiment.

As shown in FIG. 4, the EMVA 110 of the second preferred embodiment is preferably identical to the EMVA 10 of the first preferred embodiment, except as described below. The EMVA 110 of the second preferred embodiment does not include an armature. Rather, the modified plunger 114 of the second preferred embodiment performs two functions: (1) to cooperate with the first solenoid coil 38 and the second solenoid coil 40 to move the valve head 12; and (2) to cooperate with the fluid 20 and specific regions of a cavity 118 of the modified housing 116 to provide a resistance to its own movement. The cavity 118 of the housing 116 of the second preferred embodiment, like the cavity 18 of the housing 16 of the first preferred embodiment, includes a first region 142, a second region 144, and a third region 146. The exact shape of the cavity 18 may include any of the three variations of the cavity 118 of the first preferred embodiment, or any other suitable variation.

Although the preferred embodiments of the invention have been described with respect to a single EMVA (an intake valve), the preferred embodiments can be used on with multiple EMVAs (both intake and exhaust valves) within an engine.

As a person skilled in the art will recognize from the previous detailed description and from the figures and claims, modifications and changes can be made to the preferred embodiments of the invention without departing from the scope of this invention defined in the following claims.

We claim:

1. An electromagnetic valve actuator, comprising:

a valve head that moves between an open position, a middle position, and a closed position;

an armature coupled to said valve head;

a first cavity surrounding said armature;

a solenoid coil that selectively creates an electromagnetic force on said armature to move said valve head between the open position, the middle position, and the closed position;

a plunger coupled to said valve head;

a second cavity surrounding said plunger and containing a fluid, said second cavity having an inner wall defining a first region, a second region, and a third region; and said first region configured to cooperate with said plunger and the fluid to provide increasing resistance as said valve head moves with respect to the second cavity from the middle position to the closed position, wherein a cross-sectional area of said first region decreases in a direction where said valve head moves from the middle position to the closed position.

2. The electromagnetic valve actuator of claim 1 wherein said second region is configured to cooperate with said plunger and the fluid to provide increasing resistance as said valve head moves from the middle position to the open position, and wherein a cross-sectional area of said second region decreases in a direction where said valve head moves from the middle position to the open position.

3. The electromagnetic valve actuator of claim 2 wherein said third region is between said first region and said second region, said third region has a greater cross-sectional area than said first region, and said third region has a greater cross-sectional area than said second region.

4. The electromagnetic valve actuator of claim 3 wherein said first region and said second region are defined by substantially conical shapes.

5. An electromagnetic valve actuator, comprising:

a valve head that moves along an axis between an open position, a middle position, and a closed position;

a plunger coupled to said valve head; and a housing defining a cavity and an axial channel in fluid connection with each other, said cavity surrounding said plunger and containing a fluid, said axial channel having a first region, a second region, and a third region, said first region cooperating with said plunger and the fluid to provide increasing resistance as said valve head moves from the middle position to the closed position, wherein a radial depth of said first region decreases in a direction where said valve head moves from the middle position to the closed position, a width being generally perpendicular to the radial depth is substantially constant along said axial channel, and said axial channel is proximal to said cavity.

6. The electromagnetic valve actuator of claim 5 wherein said second region is configured to cooperate with said plunger and the fluid to provide increasing resistance as said valve head moves from the middle position to the open position, and wherein a radial depth of said second region decreases in a direction along said axis said valve head moves from the middle position to the open position.

7. The electromagnetic valve actuator of claim 6 wherein said third region is between said first region and said second region, said third region has a greater radial depth than said radial depth of said first region, and said third region has a greater radial depth than said radial depth of said second region.

8. The electromagnetic valve actuator of claim 5 further comprising an armature coupled to said valve head, and a solenoid coil that selectively creates an electromagnetic force on said armature to move said valve head between the open position, the middle position, and the closed position.

9. The electromagnetic valve actuator of claim 5 wherein said axis and said channel are substantially parallel.

10. The electromagnetic valve actuator of claim 5 further comprising a solenoid coil that selectively creates an electromagnetic force on said plunger to move said valve head between the open position, the middle position, and the closed position.

11. The electromagnetic valve actuator of claim 5 further comprising at least two axial channels.

* * * * *

UNITED STATES PATENT AND TRADEMARK OFFICE

CERTIFICATE OF CORRECTION

PATENT NO. : 6,817,592 B2
DATED : November 16, 2004
INVENTOR(S) : Lawrence A. Mianzo et al.

It is certified that error appears in the above-identified patent and that said Letters Patent is hereby corrected as shown below:

Title page,
Item [56], References Cited, U.S. PATENT DOCUMENTS, delete "Bonvalletg" and substitute -- Bonvallet -- in its place.
FOREIGN PATENT DOCUMENTS, before "19836562" delete "JP" and substitute -- DE -- in its place.

Signed and Sealed this

Tenth Day of May, 2005

JON W. DUDAS
*Director of the United States Patent and Trademark Office*